United States Patent [19]

Freytag

[11] 3,991,335

[45] Nov. 9, 1976

[54] AXIAL ION SOURCE FOR PRODUCING A HIGH INTENSITY BEAM FOR A CYCLOTRON

[75] Inventor: Jean-Pierre Freytag, Paris, France

[73] Assignee: C.G.R.-Mev., France

[22] Filed: Dec. 16, 1975

[21] Appl. No.: 641,172

[30] Foreign Application Priority Data

Dec. 20, 1974 France ..... 74.42372

[52] U.S. Cl. ..... 313/32; 313/62; 313/231.4; 313/237; 313/146

[51] Int. Cl.[2] ..... H01J 1/02

[58] Field of Search ..... 313/62, 231.3, 231.4, 313/237, 146, 32, 149

[56] References Cited

UNITED STATES PATENTS 2,504,585 4/1950 Reid ..... 313/32 X

*Primary Examiner*—Robert Segal
*Assistant Examiner*—Darwin R. Hostetter
*Attorney, Agent, or Firm*—Cushman, Darby & Cushman

[57] ABSTRACT

An axial ion source comprising a tubular anode having an axis XX, at the two ends of which there are placed a cathode located along said axis XX and anticathode which comprises a circular plate having an axis YY parallel to the axis XX, this plate being able to revolve about this axis YY. A device controls the sequential rotation of the anticathode about the axis YY, the rotation of the anticathode enabling a new intact surface to be presented, when necessary, at the end of the anode. A cooling fluid can circulate in the grooves equipping the plate.

8 Claims, 2 Drawing Figures

AXIAL ION SOURCE FOR PRODUCING A HIGH INTENSITY BEAM FOR A CYCLOTRON

The invention relates to an ion source enabling an ion beam of high intensity to be supplied at the centre of a cyclotron.

This ion source of the "Penning source" type comprises a tubular anode, at the two ends of which a cathode and an anticathode are placed respectively, between which an electric arc ionising the gas introduced into the tubular anode can be created. The ions so obtained are extracted from the anode by means of an electrode placed in front of the hole fashioned in this anode.

For a Penning source to function satisfactorily, it is necessary that the cathode and anticathode should be substantially at the same potential. If the anticathode is insulated electrically from the cathode, its potential is automatically fixed at the potential of the cathode, if its temperature remains low enough to avoid any thermoelectric emission.

However, if it is intended to obtain an intense ion beam or heavily charged ions, a powerful ionising discharge must be used, which increases considerably the temperature of the anticathode, so that it emits electrons, as a result of which the operating of the ion source is disturbed and the potential of the anticathode tends to approach that of the anode.

The axial ion source according to the invention enables an intense ion beam to be supplied without such drawbacks.

According to the invention, an axial ion source for producing a high intensity beam for a cyclotron, said cyclotron being associated with an electromagnet having two circular pole pieces, said ion source comprising a tubular anode termed "source body" having an axis XX, at the ends of which there are provided respectively a cathode consisting of a filament which can be brought to a high temperature and an anticathode, said anticathode consisting of a circular plate equipped with an axial mandrel having an axis YY parallel to said axis XX, which is perpendicular to the said plate; means for enabling said anticathode to be fixed on one of said circular pole peaces of the cyclotron, which axis are coincidental with said axis YY; means for enabling said anode and said cathode to be made integral with the other circular pole piece; said mandrel being linked to a device enabling the sequential rotation of said anticathode about said axis YY to be controlled and means for enabling said anticathode to be displaced longitudinally along said axis YY.

For the better understanding of the invention and to show how the same may be carried into effect, reference will be made to the drawing accompanying the insuing description and in which.

Figure 1:
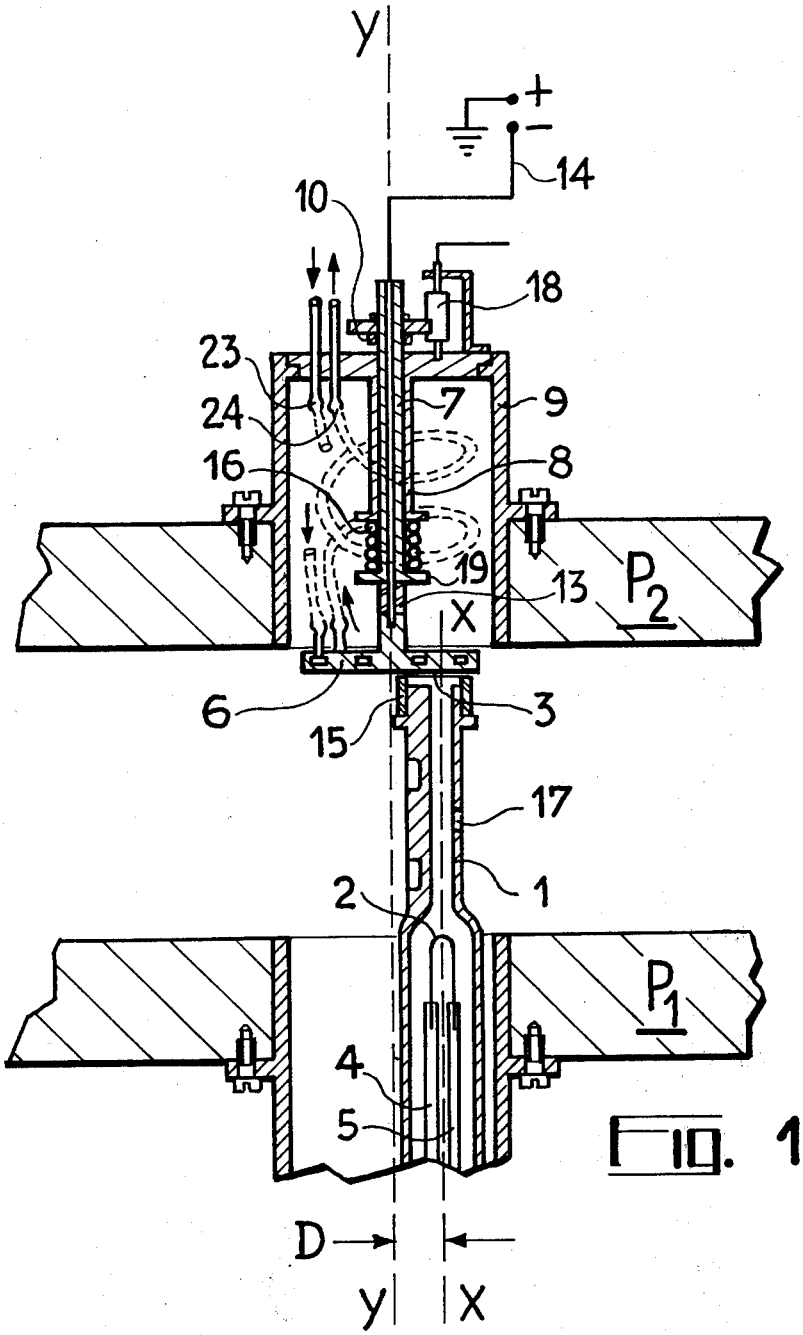
FIG. 1 is an ion source according to the invention, disposed in the centre of the pole pieces of a cyclotron.

The axial ion source according to the invention, shown in FIG. 1, is located between the two circular pole pieces $P_1$ and $P_2$ of a cyclotron and in the axial zone of this cyclotron.

This axial ion source comprises a tubular anode or "source body" 1 having an axis XX, at the two ends of which a cathode 2 and an anticathode 3 are placed respectively. The cathode 2, of known type, consists of a filament carried by supports 4 and 5 which can be hollow to permit the circulation of a cooling fluid. The cathode 2 is integral with the source body 1 and there are means allowing the assembly of cathode 2 and source body 1 to be positioned appropriately in relation to the axis YY of the circular pole pieces $P_1$, $P_2$. The axis XX of the source body 1 is eccentric in relation to the axis YY of the circular pole pieces $P_1$ and $P_2$.

The anticathode 3 consists of a circular plate 6 equipped at its centre by a cylindrical mandrel 7 perpendicular to the plate 6.

The mandrel 7 can slide in a guide sleeve 8 disposed in the centre of a supporting case 9 intended to be fixed to one of the pole pieces $P_1$ and $P_2$ ($P_2$ for example) and so enable the anticathode 3 to be positioned appropriately in relation to the pole pieces $P_1$ an $P_2$, the axis of the mandrel 7 being coincidental with axis YY. A removable stop piece 10 allows the travel of the mandrel 7 in the sleeve 8 to be limited.

Figure 2:
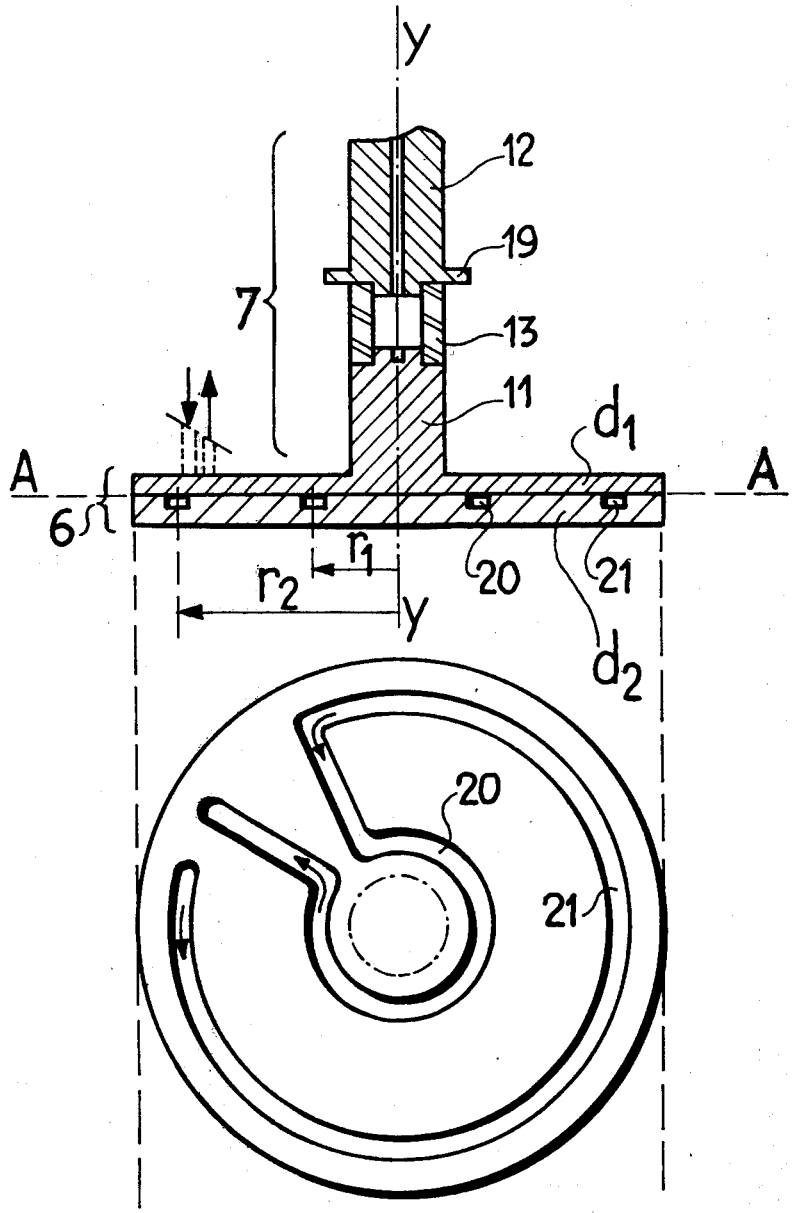
FIG. 2 is a detailed view of an anticathode in an ion source according to the invention.

The mandrel 7, of a metallic material, for example, can be constituted by a first cylindrical bar 11, as shown in FIG. 2, and a second tubular cylindrical bar 12, electrically insulated one from the other by a ring 13 of an electrically insulating material. A connecting wire 14 (FIG. 1) passing through the mandrel 7 makes it possible appropriately to polarise the anticathode 3 in relation to the "source body" 1.

The end of the "source body" 1 placed face to face with the anticathode 3 is equipped with an insulating jacket 15 of an electrically insulating material, as shown in FIG. 1.

A helical spring 16 is placed around the mandrel 7 between the free end of the sleeve 8 and a shoulder 19 of the mandrel 7, so that the plate 6 comes to rest against the insulating jacket 15 with a predetermined pressure, thereby enabling an appropriate tightness to be achieved for the gas to be ionised which is introduced into the "source body" 1.

In operation, the anticathode 3 which rests on the insulating jacket 15 is kept at a potential of a few hundred Volts in relation to the "source body" 1. The discharge created in the "source body" 1 (containing the gas to be ionised) between the cathode 2 and the anticathode 3 gives rise to a plasma from which the ions are extracted through a hole 17 in the "source body" 1 by means of an extracting electrode (not shown in the figure) disposed in front of the hole 17.

After a certain operating period, the portion of the plate 6 placed face to face with the cathode 2 has a crater due to sputtering of this cathode 2. A device 18 makes it possible to control the sequential rotation of the plate 6 of the anticathode 3 about axis YY by an angle $\theta$ of predetermined value, so that the plate 6 again presents an intact surface in front of the "source body" 1. In the embodiment shown in FIG. 1, the device 18 is a gear with one degree of freedom.

In order to limit the surface temperature of the anticathode 3, a system for cooling this anticathode 3 is provided.

In the embodiment shown in the FIG. 2, the plate 6 of the anticathode 3 consists of two superimposed discs $d_1$ and $d_2$. The face A of one of the discs (disc $d_1$ for example) is provided with concentric circular grooves 20 and 21 which, after brazed sealing of the other disc $d_2$ on this face A, form a circulating channel for a cooling fluid. If $r_1$ and $r_2$ are the respective radii of the two grooves 20 and 21 joined together as shown in FIG. 2, the distance D (FIG. 1) separating axis XX and YY should be equal to:

$$D = \frac{r_1 + r_2}{2}$$

After a certain period of operating it may be necessary to replace the ion source. This replacement can be carried out in two separate operations: replacement of the "source body" 1 and cathode 2, on the one hand, and replacement of the anticathode 3, on the other.

The "source body" 1 and cathode 2 are fixed on the end of a rod (not shown in FIG. 1) which can penetrate to the centre of the cyclotron by means of a first lock (not shown in FIG. 1). The latter enables a vacuum to be maintained inside the cyclotron when this rod is withdrawn from it. The supporting case 9 can also be equipped in its lower part with a second lock (not shown in FIG. 1) which allows the working pressure to be maintained in the "source body" 1 and in the cyclotron when the anticathode 3 is being replaced after executing a predetermined number of sequential rotations. The upper part 22 of the supporting case 9 is removable and enables the anticathode 3 to be withdrawn from this supporting case 9 when the second lock is closed.

Such an axial ion source whose anticathode 3, effectively cooled and moving about the axis YY, enabling intact surfaces to be presented, which are renewed several times on the corresponding end of the "source body" 1, is of particular advantage in compact cyclotrons with a high flow of ions.

In the non-restritive embodiment described above, the cooling fluid for the anticathode 3 is delivered to the grooves 20 and 21 and discharged by means of flexible pipes 23 and 24 which allow the sequential rotation of the plate 6 about the axis YY.

What I claim is:

1. An axial ion source for producing a high intensity beam for a cyclotron, said cyclotron being associated with two circular pole pieces, said axial ion source comprising a tubular anode termed "source body" having an axis XX, at the two ends of which there are provided respectively a cathode consisting of a filament which can be brought to a high temperature and an anticathode, said anticathode consisting of a circular plate equipped with an axial mandrel having an axis YY parallel to said axis XX, said mandrel being perpendicular to the said plate; means for enabling said anticathode to be fixed to one of said circular pole pieces in such a manner that the axis of said pole piece is coincidental with said axis YY; means for enabling said anode and said cathode to be made integral with the other circular pole piece, said mandrel being linked to a device allowing a sequential rotation of said anticathode about said axis YY to be controlled and means for enabling said anticathode to be displaced longitudinally along said axis YY.

2. An axial ion source as claimed in claim 1, wherein said mandrel consists of two cylindrically shaped metal bars electrically insulated one from the other by means of a ring of eletrically insulating material, means being provided for enabling said circular plate of the anticathode to be kept substantially at the same potential as that of said cathode.

3. An axial ion source as claimed in claim 1, wherein said mandrel is carried by a supporting case which can be fixed to one of said circular pole pieces, said supporting case having an axis which is coincidental with said axis YY.

4. An axial ion source as claimed in claim 1, wherein said anode has an extremity facing said anticathode, said extremity being equipped with a insulating jacket of electrically insulating material on which said anticathode can come to press.

5. An axial ion source as claimed in claim 3, wherein said supporting case is equipped along said axis YY with a guide sleeve in which said mandrel can slide, said mandrel being provided with a stop piece enabling the travel of said mandrel in said guide sleeve to be limited.

6. An axial ion source as claimed in claim 4, wherein said circular plate is pressed on said insulating jacket by means a helical spring disposed around said mandrel, between the free end of said guide sleeve and said circular plate of the anticathode, in such a manner that said circular plate is pressed on said insulating jacket with a predetermined pressure.

7. An axial ion source as claimed in claim 1, wherein said circular plate of said anticathode consists of two metal discs brazed one on the other, one of said discs being equipped, on its face in contact with said other disc, with concentric circular grooves in which a cooling fluid can circulate.

8. An axial ion source as claimed in claim 7, wherein said cooling fluid is to be delivered to said grooves by means of flexible pipes which are disposed spirally around said mandrel in said supporting case.

* * * * *